US005248207A

United States Patent [19]

Yamamoto et al.

[11] Patent Number: 5,248,207

[45] Date of Patent: Sep. 28, 1993

[54] THERMAL PRINTER PROVIDED WITH DETACHABLE HEAD UNIT HAVING BUILT-IN THERMAL HEAD UNIT

[75] Inventors: Junichi Yamamoto; Yutaka Maeda, both of Osaka, Japan

[73] Assignee: Minolta Camera Kabushiki Kaisha, Osaka, Japan

[21] Appl. No.: 750,117

[22] Filed: Aug. 26, 1991

[30] Foreign Application Priority Data

Aug. 27, 1990 [JP] Japan ..... 2-224717
Aug. 27, 1990 [JP] Japan ..... 2-224718

[51] Int. Cl.[5] ..... B41J 2/325/32/00; B41J 29/02

[52] U.S. Cl. ..... 400/120; 400/208; 400/613; 400/692; 400/693.1

[58] Field of Search ..... 400/120, 208, 613, 692, 400/693, 693.1; 346/76 PH, 145

[56] References Cited

U.S. PATENT DOCUMENTS

| | | | |
|---|---|---|---|
| 4,641,980 | 2/1987 | Matsumoto et al. | 400/693 |
| 4,949,097 | 8/1990 | Imaseki | 346/76 PH |
| 5,020,926 | 6/1991 | Wilhelm | 400/693 |
| 5,044,801 | 9/1991 | Uchimura et al. | 400/692 |

FOREIGN PATENT DOCUMENTS

| | | | |
|---|---|---|---|
| 49972 | 3/1985 | Japan | 400/120 |
| 116477 | 6/1985 | Japan | 400/208 |
| 61-68275 | 4/1986 | Japan . | |
| 68276 | 4/1986 | Japan | 400/692 |
| 83077 | 4/1986 | Japan | 400/208 |
| 213184 | 9/1986 | Japan | 400/692 |
| 256675 | 11/1987 | Japan | 400/692 |
| 297159 | 12/1987 | Japan | 400/208 |
| 63-188153 | 12/1988 | Japan . | |

OTHER PUBLICATIONS

IBM Technical Disclosure Bulletin, "Cassette Containing Both Ribbon and Print Head", vol. 23 No. 9, Feb. 1981.

*Primary Examiner*—Edgar S. Burr
*Assistant Examiner*—Stephen R. Funk
*Attorney, Agent, or Firm*—Willian Brinks Olds Hofer Gilson & Lione

[57] ABSTRACT

A thermal printer has detachably attached to a frame assembly of a printer a print unit having a built-in thermal head. The print unit accommodates therein an inked ribbon. By a drive member installed within the frame assembly, the thermal head is pressed against the platen roller and consequently driven thereby. The print unit is provided with a unit case and a cover allowed to be opened or shut relative to the unit case. The inked ribbon can be attached to or detached from the interior of the unit case. The unit is capable of incorporating the platen roller therein. In this case, the opening of the cover induces formation of an opening between the platen roller and the thermal head. The unit incorporating the platen roller therein is not required to be provided in the frame assembly thereof with the drive member which would cause the thermal head to be pressed against the platen roller by virtue of a spring member and and consequently induce a displacement of the thermal head. The use of a roll of thermosensitive recording paper in the unit obviates the necessity for the inked ribbon.

9 Claims, 15 Drawing Sheets

THERMAL PRINTER PROVIDED WITH DETACHABLE HEAD UNIT HAVING BUILT-IN THERMAL HEAD UNIT

BACKGROUND OF THE INVENTION

1. Field of the Invention

This invention relates to a thermal printer which is provided with a platen roller and a thermal head pressed against the platen roller through the medium of a recording paper and is adapted to form an image on the recording paper.

2. Description of the Related Art

A thermal printer is possessed of a thermal head which is pressed against a platen roller through the medium of a recording paper. The thermal printer comes in two types; the one type using a recording medium in the form of an inked ribbon or inked film and forming an image on the recording paper by transferring the ink applied on this ribbon onto the recording paper and the other type using a recording medium in the form of a thermosensitive paper by directly forming an image on a thermosensitive paper without using any inked ribbon.

The thermal printer of this construction is characterized by having a relatively small size and operating at a low cost as compared with other systems for recording an image on a recording paper. The conventional thermal printer, however, is limited in miniaturization because it requires to secure an exchange space for allowing attachment and detachment of an ink ribbon to and from a frame assembly or printer body and an escape space for allowing retraction of the thermal head during the exchange of the ink ribbon. Further, the conventional thermal printer has unsolved problems concerning further reduction in production cost, reduction in weight, improvement in operability, facilitation of maintenance such as of the thermal head, facilitation of exchange of consumable supplies such as a recording paper and an inked ribbon, facilitation of troubleshooting, and so on.

Japanese Patent Laid-Open 61-68,275, for example, discloses a printer which has an inked film, a thermal head, and a switch drive mechanism for driving the thermal head accommodated in a unit case adapted to be attached to and detached from a printer frame. In this printer, the operator's manual operation of the switch drive mechanism causes the unit case to be attached to or detached from the printer frame and, at the same time, causes the thermal head to be pressed against or moved away from a platen roller disposed inside the printer frame. In this printer, however, since the aforementioned switch drive mechanism for causing the thermal head to be pressed against or moved away from the platen roller is disposed inside the unit case, the unit case is voluminous, heavy, expensive, and irksome in the work of attachment and detachment. Further, the exchange of consumable supplies and the work of troubleshooting are not easy. Thus, this printer has problems concerning reduction in size, reduction in cost, reduction in weight, improvement in operability, etc. The idea of inserting or removing the inked ribbon into or from the printer through the upper side of the printer frame or in the direction of the axis of rotation of the platen roller has been materialized for the purpose of precluding the work of retracting the thermal head during the insertion or removal of the inked ribbon and obviating the necessity for allocating an extra escape space to the retraction. This device, however, has a problem of poor operability because the operation for inserting or removing the inked ribbon into or from the printer frame cannot be carried out on the front side of the printer frame.

SUMMARY OF THE INVENTION

An object of this invention is to provide a thermal printer which allows further reduction in size, weight, and cost and, at the same time, excels in operability owing to facilitation of the work of exchange of consumable supplies and the work of troubleshooting.

Another object of this invention is to provide a thermal printer which allows attachment to or detachment from the printer frame a print unit having a thermal head and an inked ribbon recording medium built therein.

Yet another object of this invention is to provide a thermal printer which allows attachment to or detachment from the printer frame a print unit having a thermal head, a platen roller, and an inked ribbon built therein.

Still another object of this invention is to provide a thermal printer which allows attachment to or detachment from the printer frame a print unit having a thermal head, a platen roller, an inked ribbon, and a recording paper built therein.

A further object of this invention is to provide a thermal printer which allows attachment to or detachment from the printer frame a print unit having a thermal head and a thermosensitive recording paper recording medium built therein.

A still further object of this invention is to provide a thermal printer which allows attachment to or detachment from the printer frame a print unit having a thermal head, a platen roller, and a thermosensitive recording paper built therein.

In accordance with the present invention, there is provided a thermal printer possessing a platen roller and a thermal head adapted to be pressed against said platen roller through the medium of a recording paper and recording an image on said recording paper by heating said recording paper, comprising a print unit for displaceably retaining and accommodating therein said thermal head, accommodating an inked ribbon therein, and allowing itself to be attached to or detached from said thermal printer body and pressing means installed in said thermal printer body and adapted to press said thermal head against said platen roller.

DESCRIPTION OF THE PREFERRED EMBODIMENTS

Figure 1:
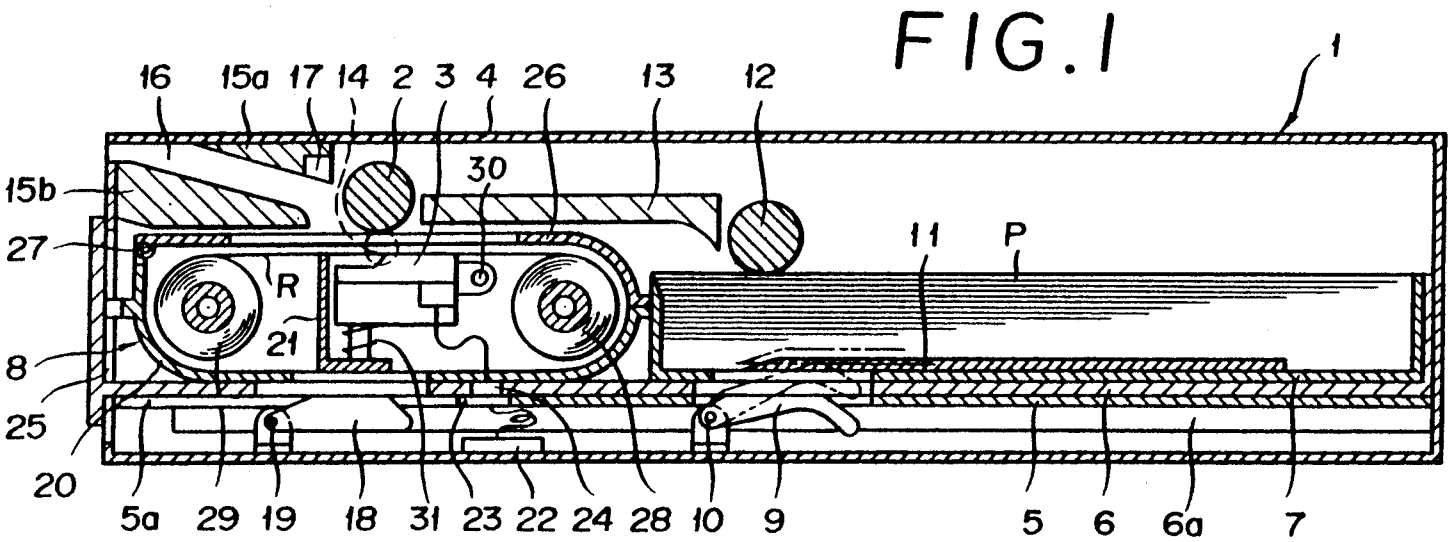
FIG. 1 is a cross section illustrating a thermal printer as the first embodiment of this invention in a position having a print unit and a paper-feeding cassette disposed inside a printer frame.

A thermal printer 1 shown in FIGS. 1 to 4 is provided with a platen roller 2, and a thermal head 3 pressed as heated against the thermal head 3 through the medium of a recording paper P and an inked film or inked ribbon R as a recording medium. On the recording paper P, an image is formed with the ink from the ink ribbon R thermally transferred. The illustrated platen roller 2 is disposed rotatably in both directions inside the main body of the thermal printer 1 or a frame assembly 4. On a guide plate 5 provided in the lower part of the frame assembly 4, a moving tray 6 is mounted so as to be moved in both ways in the longitudinal direction in the bearings of the diagram. On the moving tray 6, a paper-moving cassette 7 is mounted on the right side and a print unit 8 on the left side in the bearings of the diagram. These components are adapted to be incorporated in the frame assembly 4 mentioned above.

A pin 10 is attached to a bracket which is disposed substantially in the middle of the lower part of the frame assembly 4 and the basal terminal part of a paper-feeding lever 9 is attached to this pin 10 and the leading terminal part of the paper-feeding lever 9 is adapted to be moved vertically. This paper-feeding lever 9 is vertically moved by a drive member (not shown). On the bottom wall of the paper-feeding cassette 7, a pressure plate 11 is seated so as to be vertically moved. When the paper-feeding lever 9 is set driving, it is raised through openings formed in the bottom walls respectively of the guide plate 5, the moving tray 6, and the paper-feeding cassette 7 and pressed against the pressure plate 11. Inside the paper-feeding cassette 7, a multiplicity of sheetlike recording papers P are accommodated as piled up on the pressure plate 11. A paper-feeding roller 12 held in contact with the uppermost of these recording papers is disposed above the paper-feeding lever 9 inside the frame assembly 4. This paper-feeding roller 12 is rotationally driven in the clockwise direction in the bearings of the diagram.

Inside the frame assembly 4, a guide 13 for guiding the recording papers P is attached as interposed between the paper-feeding roller 12 and the platen roller 2 and paper-retaining rollers 14 adapted to be pressed upwardly against the platen roller 12 by virtue of a spring (not shown) are disposed. These paper-retaining rollers 14 are so disposed as to be pressed against the platen roller 12 through the medium of the lateral part of the recording papers P and prevented from interfering with the print unit 8. A conveying path 16 for discharging used recording papers P out of the printer is defined by upper and lower guides 15*a*, 15*b* which are fixed inside the frame assembly 4. The upper guide 15*a* is provided with a paper sensor 17 adapted to detect the leading end of a recording paper P being conveyed.

Figure 2:
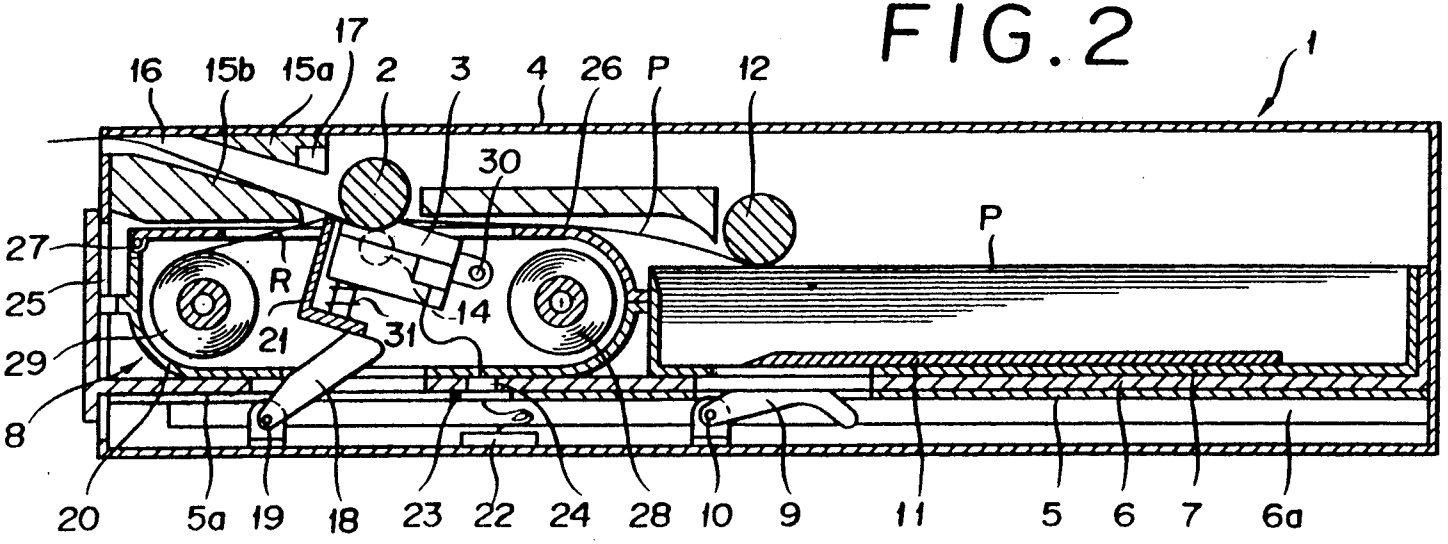
FIG. 2 is a cross section illustrating the thermal printer shown in FIG. 1 in a position performing the work of printing.

To a pin 19 which is attached through the medium of the bracket to the lower part of the front terminal part of the frame assembly 4, a drive lever 18 is attached by the basal terminal part thereof. The leading terminal part of this drive lever 18 is adapted to be moved vertically by a drive member (not shown). This drive lever 18 constitutes itself a drive mechanism for causing the thermal head 3 disposed inside a unit case 20 of the print unit 8 to be pressed against the platen roller 2 or removed from the platen roller 2 and moved away therefrom and, therefore, corresponds to a drive mechanism for the conventional printer described above. When this drive lever 18 is driven upwardly, it presses an operating member 21 attached to the thermal head 3 through openings formed in the guide plate 5, the moving tray 6, and the unit case 20 at the positions corresponding to the position of the drive lever 18. As a result, the drive lever 18 presses the thermal head 3 against the platen roller 2 through the medium of the inked ribbon R and the recording paper P as illustrated in FIG. 2.

A control part 22 is provided for the frame assembly 4. This control part 22 is connected through the medium of a cable to a connector 23 which is attached downwardly protrudingly to the lower side of the moving tray 6. To the unit case 20, a connector 24 projected from the lower side thereof is attached. This connector 24 is connected to the thermal head 3 through the medium of a cable. When the print unit 8 is moved and mounted on the moving tray 7, the connector 24 is fitted into a through hole formed in the moving tray 7 and brought into contact with the connector 23. As a result, the thermal head 3 is electrically connected to the control part 22. From the control part 22, an electric energy is supplied and, at the same time, such electric signals of data, clock, latch, and strobe which have been introduced as from an external computer and processed by the control part 22 are transmitted to the thermal head 3.

Figure 3:
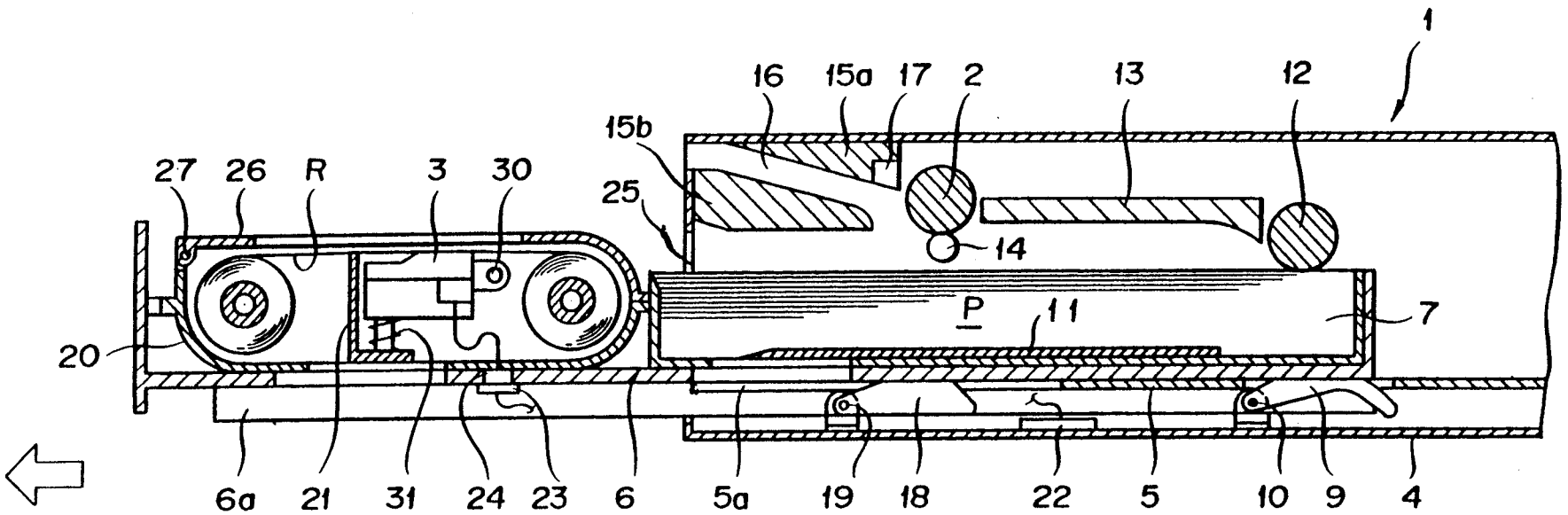
FIG. 3 is a cross section illustrating the thermal printer in process of removal of the print unit.

This printer 1 has the front side at the left terminal part of the frame assembly 4 in the bearings of the diagram. It has an open part 25 formed in the front side part. While the printer 1 is in a position having the moving tray 6 drawn out past the open part 25 in the direction of conveyance of the recording papers P as illustrated in FIG. 3, the attachment and detachment of the print unit 8 and the paper-feeding cassette 7 into and out of the moving tray 6 are carried out. When the moving tray 6 in a position having the print unit 8 and the paper-feeding cassette 7 incorporated in place therein is driven into place, the print unit 8 and the paper-feeding cassette 7 are set at their prescribed positions inside the frame assembly 4. A slit 5*a* for allowing passage of the connector 23 during the movement of the moving tray 6 is formed in the guide plate 5. To allow the moving tray 6 smooth movement, a guide projection 6*a* is extended from the lower side of the tray 6 in the direction of movement thereof. This guide projection 6*a* is meshed with a slit (not shown) formed in the guide plate 5.

Figure 5:
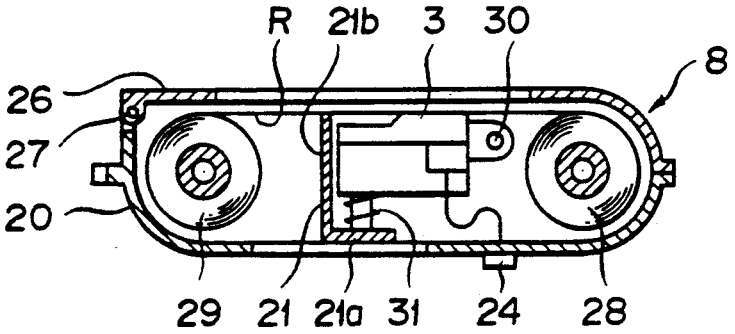
FIG. 5 is a cross section illustrating the print unit shown in FIGS. 1 to 4.
Figure 6:
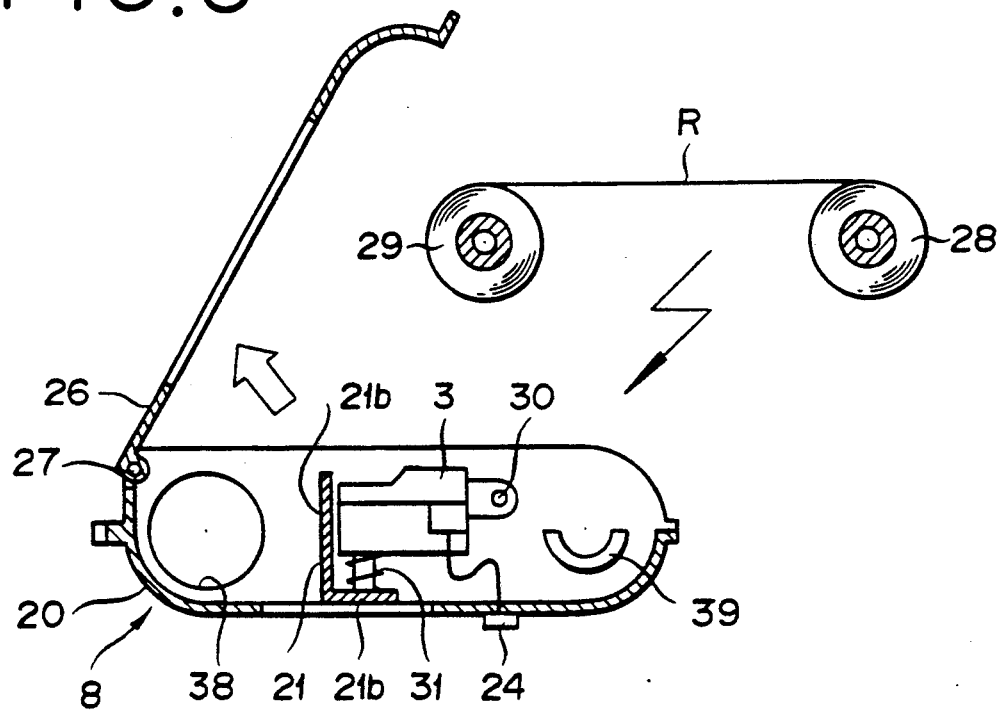
FIG. 6 is a cross section illustrating the print unit in a position allowing insertion of the inked ribbon through an opening formed by an upper cover.
Figure 7:
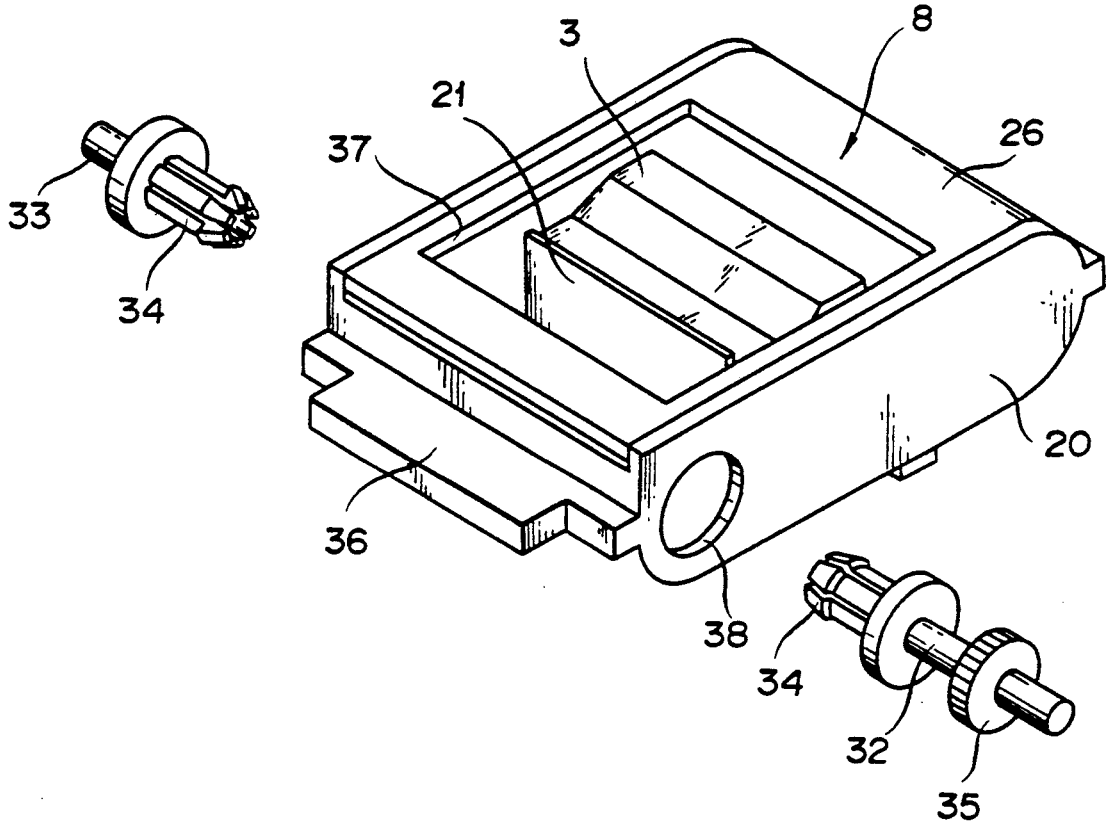
FIG. 7 is a perspective view illustrating the outward appearance of the print unit.

FIGS. 5 to 7 illustrate the print unit 8. This print unit 8 is provided with the unit case 20 mentioned above and an upper cover 26 adapted to be opened and shut with a pin 27 relative to the unit case 20. Inside the unit case 20, the inked ribbon R which is wound on a supply reel 28 and rewound on a take-up reel 29 is detachably accommodated. The thermal head 3 is set on a supporting shaft 30 inside the unit case 20 so as to be shaken around the supporting shaft 30.

The inked ribbon R is formed by applying a pigment type thermally meltable or dye type thermally sublimable solid ink on a base film. Where a color image is to be printed, for example, an inked film having solid inks of the three colors, i.e. yellow, magenta, and cyan, applied severally in a fixed length repeatedly in the order mentioned is used. On the thermal head 3, a multiplicity of heating elements are rectilinearly arrayed. These elements are selectively heated by electrification. This heating is carried out on the basis of data emitted severally relative to the three colors by the control part 22.

The operating member 21 is provided with a basal terminal part 21*a* and a peel part 21*b* rising perpendicularly relative thereto and is possessed of a cross section substantially of the shape of the letter L. This operating member 21 fulfills not only the function of transmitting the pressing force of the drive lever 18 through the medium of a spring 31 to the thermal head 3 and pressing the thermal head 3 against the platen roller 2 but also the function of peeling the inked ribbon R from the recording paper P which has passed the gap between the thermal head 3 and the platen roller 2 as illustrated in FIG. 2. The spring 31 is interposed between the thermal head 3 and the basal terminal part 21*a* of the operating member 21 and adapted to effect adjustment of the pressing force exerted by the thermal head 3 on the platen roller 2.

As illustrated in FIG. 7, the unit case 20 has two supporting shafts 32, 33 set in place. These supporting shafts are each provided with a plurality of engaging pieces 34 possessed of a projection at the leading end thereof. The supporting shafts 32, 33 are inserted into the unit case 20 severally through supporting holes 38 formed in the unit case 20 and the engaging pieces 34 are inserted into the core part of the take-up reel 29. The core part of the supply reel 28 is supported in place by semicircular supporting parts 39 projected inwardly from the unit case 20. The supporting shaft 32 is provided with a toothed wheel 35 and the toothed wheel 35 is meshed with a drive toothed wheel (not shown) disposed inside the frame assembly 4. By a motor which drives the drive toothed wheel, the take-up reel 29 inside the print unit 8 is rotated and the inked ribbon R is conveyed as unwound from the supply reel 28 and rewound on the take-up reel 29. Optionally, the supporting shafts 32, 33 and the toothed wheel 35 may be fixed integrally with the take-up reel 29.

The unit case 20 is provided at the leading end thereof with a handle 36 as illustrated in FIG. 7. An opening 37 is formed in the upper cover 26. Through the medium of this opening 37, the thermal head 3 inside the print unit 8 is pressed against the platen roller 2. By the platen roller 2, the recording paper P and the inked ribbon R are conveyed.

The illustrated print unit 8 is provided with the unit case 20 on the lower side and the upper cover 26 adapted to be opened and shut relative thereto. Optionally, the upper cover 26 and the unit case 20 may be integrally formed so as to give rise to a tightly closed unit case. In this case, the print unit 8 inclusive of the thermal head 3, the inked ribbon R, the supply reel 28, and the take-up reel 29 accommodated therein forms a disposable item.

Now, the procedure for printing an image on the recording paper P by thermally transferring the ink from the inked ribbon R by the use of the thermal printer 1 described above will be explained below.

When a print-starting switch (not shown) is depressed, the paper-feeding lever 9 is raised as indicated by a two-dot chain line and, at the same time, the paper-feeding roller 12 is rotationally driven as illustrated in FIG. 2. As a result, just one of the recording papers P is sent out of the paper-feeding cassette 7 toward the left in the bearings of FIG. 2. The recording paper P thus sent out passes the gap between the guide 13 and the cover 26 of the print unit 8 and reaches the gap between the platen roller 2 and the paper-retaining roller 14 pressed against the platen roller 2. After the leading end of the recording paper P collides against and fits into the nipping part between the platen roller 2 and the paper-retaining roller 14, the recording paper P is conveyed by the rotation of the platen roller 2. During the conveyance, the paper-feeding lever 9 is returned to a lowered position as indicated by a solid line in FIG. 2.

When the recording paper P is conveyed to the position at which the leading end thereof is detected by the paper sensor 17, the drive lever 18 is moved upwardly as illustrated in FIG. 2 and the thermal head 2 is pressed against the platen roller 2 across the recording paper P and the inked ribbon R through the medium of the operating member 21 and the spring 31. In this state, the printing by thermal transfer is started. FIG. 2 illustrates the state in which the printing is in process. This printing is effected by the fact that the multiplicity of heating elements provided on the thermal head 2 are selectively heated by electrification based on the data emitted from the control part 22 and consequently the ink from the inked ribbon R is thermally transferred onto the recording paper P. The recording paper P and the inked ribbon R are conveyed by the rotation as of the platen roller 2, with the result that the recording paper P is brought to the conveying path 16 and the inked ribbon R is rewound on the take-up reel 29.

To print a color image on the recording paper P, the recording paper P is returned over a prescribed distance by the reversing of the platen roller 2 and the paper-retaining roller 14 after the drive lever 18 is returned to the lowered position indicated in FIG. 1 subsequently to the completion of the first printing operation. Then, the drive lever 18 is again raised and the thermal head 3 is pressed against the platen roller 2 to effect the printing operation in the second color. The printing operation in the third color and possibly the printing operation in the fourth color are carried out in the same manner as described above. When the last printing operation is completed, the recording paper P is conveyed by the platen roller 2 and the paper-retaining roller 14 and discharged through the conveying path 16 and the drive lever 18 is returned to the lowered position.

In the thermal printer 1, the thermal head 3, the inked ribbon R, etc. are built in the print unit 8 which is adapted to be attached to and detached from the frame assembly 4 as described above and the thermal head 3 is displaced by the drive lever 18 on the printer's frame assembly 4 side. The thermal head 3 inside the print unit 8 is adapted to be electrically connected to the control part 22 through the medium of the connectors 23, 24. The thermal printer described above has the following advantages.

The drive lever 18 is provided for the frame assembly 4 and not for the printer unit 8. Since the print unit 8 of the present thermal printer is not provided with a drive member for pressing the thermal head 3 against the platen roller 2, it is allowed a reduction in size and weight. Optionally, the print unit 8 may be designed as a disposable item. Since the frame assembly 4 is not required to be provided with an exchange space for allowing insertion and removal of the inked ribbon R or with an escape space or escape mechanism for allowing retraction of the thermal head 3 during the exchange the printer is allowed a decrease in height and a further reduction in size, weight, and cost.

The printer has its front surface on the left side in the bearings of FIGS. 1 to 4. Since the attachment or detachment of the print unit 8 to or from the printer is accomplished by inserting or removing the moving tray 6 through the opening part 25, the efficiency of the operation of attaching or detaching the print unit 8 to or from the printer is improved. Particularly, since the print unit 8 is allowed a reduction in weight, the printer enjoys ideal efficiency in the operation of attachment and detachment.

Figure 4:
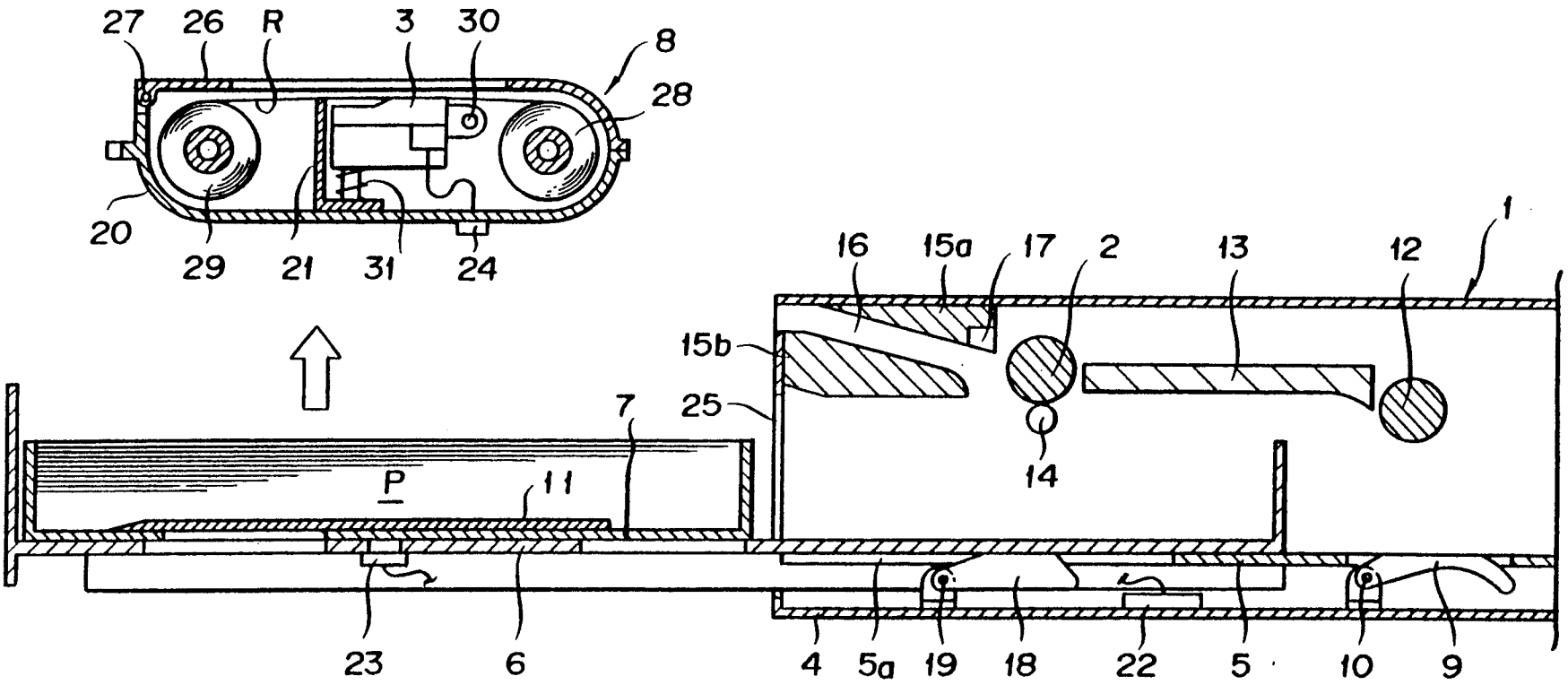
FIG. 4 is a cross section illustrating the thermal printer in a position resulting from the removal of the print unit.

The work of maintenance of the print unit 8 is facilitated by the fact that the print unit 8 can be removed from the moving tray 6 coupled with the fact that the drive lever 18 is not attached to the print unit 8. By removing the print unit 8 from the frame assembly 4 of the printer, the exchange of such consumable supplies as recording paper P and inked ribbon R can be accomplished easily. The troubleshooting such as the removal of a recording paper P stuck in the mechanism may be easily attained with the print unit 8 in a position drawn out of the frame assembly 4. From the position illustrated in FIG. 1, the moving tray 6 is drawn out past the front side of the printer to the position illustrated in FIG. 3. Then, the print unit 8 is taken out of the moving tray 6 as illustrated in FIG. 4. The paper-feeding cassette 7, when necessary, may be moved on the moving tray 6 in the direction of the front side of the printer. To exchange the inked ribbon R for a new supply, the cover 26 of the print unit 8 is opened as illustrated in FIG. 6. As a result, the exchange of the thermal head 3, the exchange of the inked ribbon R, the loading of the recording paper P, and the removal of a stuck recording paper can be easily carried out. After these works are completed, the print unit 8 is returned to the prescribed position inside the printer as illustrated in FIG. 1 by reversing the procedure described above.

Though the thermal printer 1 described above is so constructed that the moving tray 6 will be moved in the direction of conveyance of the recording paper, the printer of the present invention does not discriminate the moving tray 6 on account of the direction of its movement.

Figure 8:
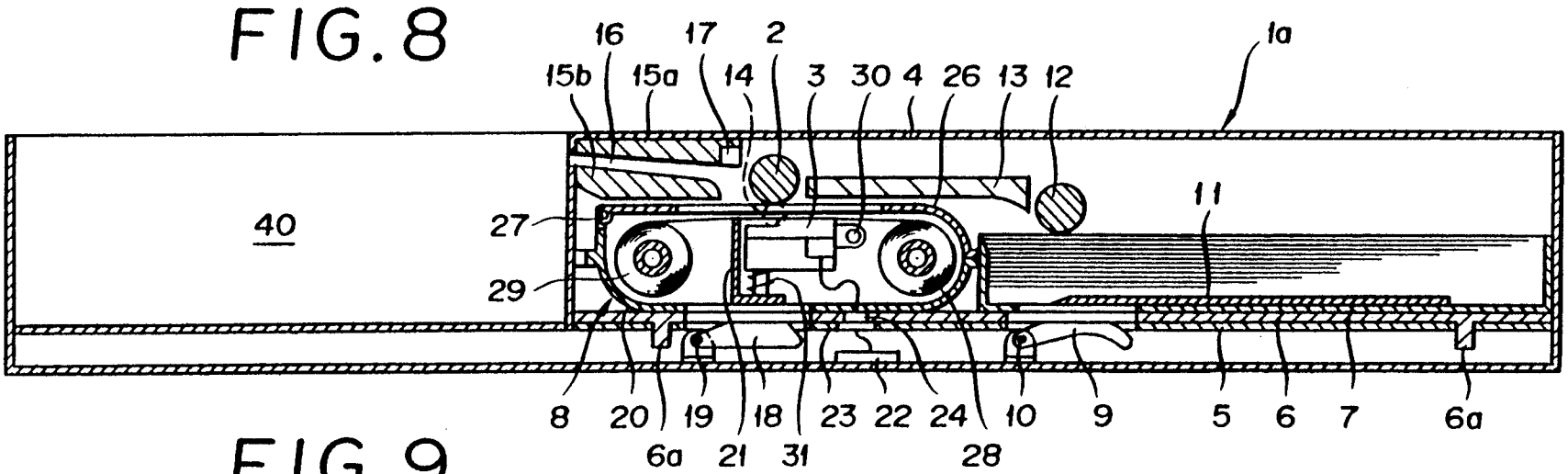
FIG. 8 is a cross section illustrating a thermal printer as the second embodiment of this invention.

A thermal printer **1*a* illustrated in FIG. 8 is so constructed that the moving tray 6 is allowed to move in the direction perpendicular to the surface of the drawing. When the moving tray 6 is moved, therefore, the print unit 8 and the paper-feeding cassette 7 during the removal or insertion are moved in the direction parallel to the axis of rotation of the platen roller 2. This printer 1*a* has its front side on the nearer side in the bearings of FIG. 8. During the removal or insertion of the moving tray 6, the guide projection 6*a* is slid as guided by the slit formed in the guide plate 5. Similarly, a thermal printer 1*b* illustrated in FIG. 9** is allowed to move in the direction perpendicular to the surface of the drawing.

In the lateral part of the thermal printer **1*a* illustrated in FIG. 8, the frame assembly 4 is provided with a paper discharge part 40 for receiving and holding used recording papers P which are discharged via the conveying path 16. In this case, the recording papers P after use are discharged to the left side of the printer. In the printer 1*b* illustrated in FIG. 9, the paper discharge part 40 for storing used recording papers P is formed on the upper side of the printer 1*b*. Into this paper discharge part 40, the used recording papers P are discharged via the conveying path 16** which has a curved shape. This invention allows the direction of discharge of the used recording papers to be selected in various directions.

Figure 9:
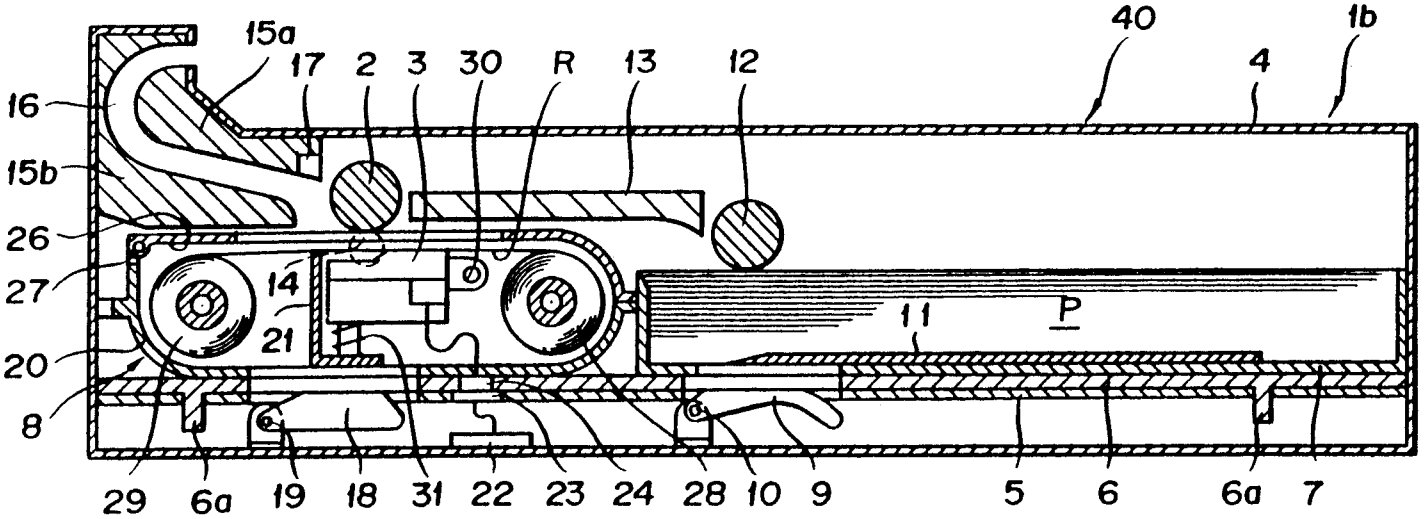
FIG. 9 is a cross section illustrating a thermal printer as the third embodiment of this invention.

In the printers **1*a*, 1*b* illustrated respectively in FIG. 8 and FIG. 9 and in printers of other types to be described hereinbelow, the component members identical with those of the thermal printer of the first embodiment illustrated in FIGS. 1 to 7** are denoted by identical reference numerals.

Figure 10:
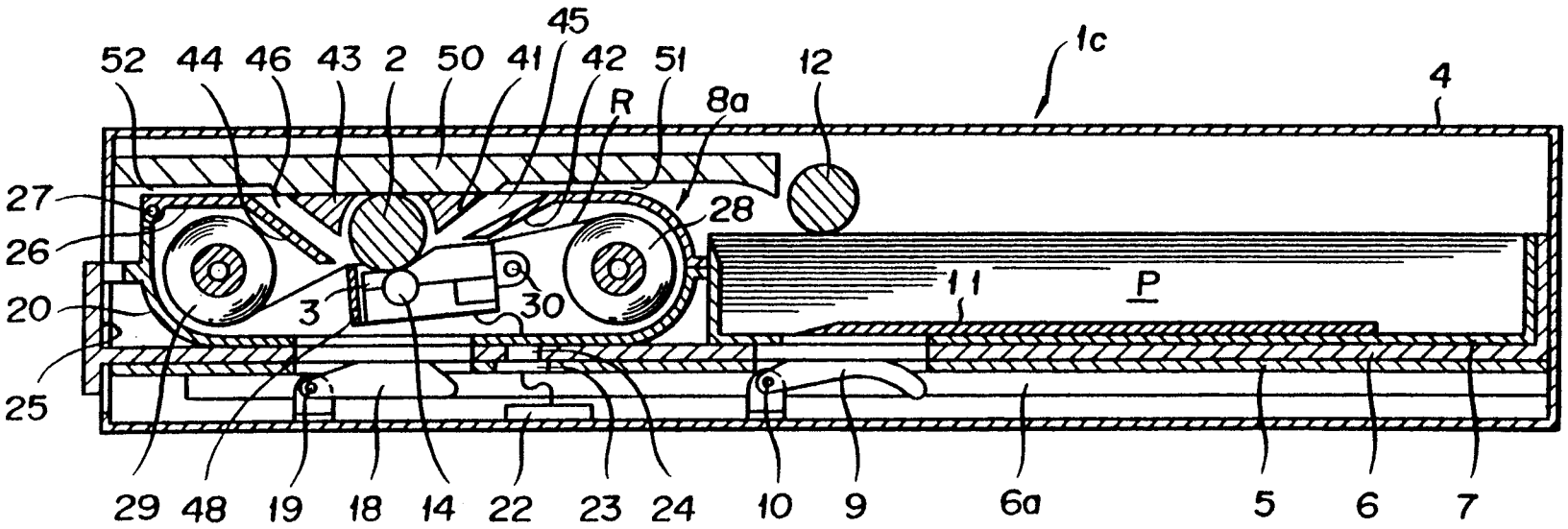
FIG. 10 is a cross section illustrating a thermal printer as the fourth embodiment of this invention.
Figure 11:
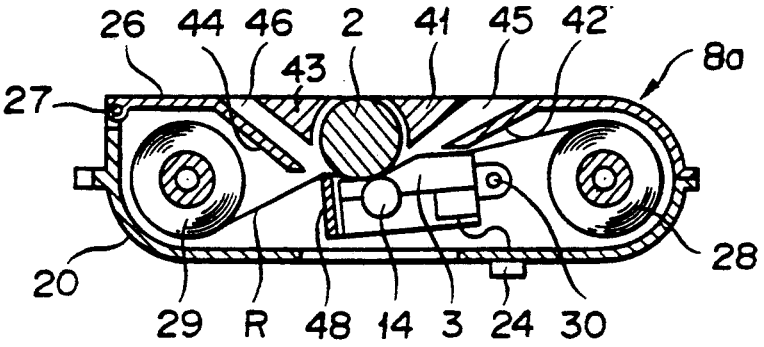
FIG. 11 is a cross section illustrating the print unit shown in FIG. 10.
Figure 12:
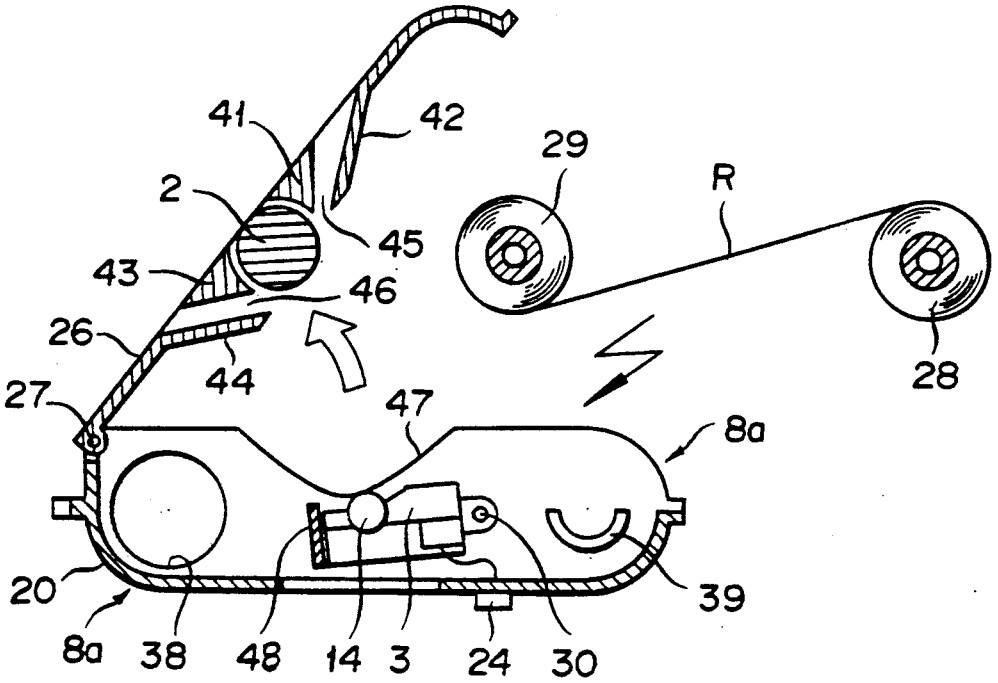
FIG. 12 is a cross section illustrating the print unit shown in FIG. 11 in a position having the upper cover opened.

FIGS. 10 to 12 represent a thermal printer **1*c* as the fourth embodiment of this invention. In this printer 1*c*, the platen roller 2 is also built in the print unit 8*a*. Inside the unit case 20, the thermal head 3 is set so as to be shaken around the pin 30 and, at the same time, the paper-retaining roller 14 is rotatably set in place as illustrated. In the upper cover 26, the platen roller 2 adapted to be pressed against the thermal head across the recording paper P and the inked ribbon R is rotatably set in place. The paper-retaining roller 14 is urged by the resilient force exerted by the spring (not shown) in the direction of the platen roller 2**.

When the upper cover 26 is opened with the print unit **8*a* in a position removed from the frame assembly 4 of the printer as illustrated in FIG. 12, the platen roller 2 is separated from the thermal head 3** to allow exchange of the inked ribbon R.

The upper cover 26 is provided on the laterally opposite sides of the platen roller 2 with upper guide members 41, 43, on the right side of the platen roller 2 with a lower guide member 42, and on the left side thereof with a lower guide member 44. The upper guide member 41 and the lower guide member 44 jointly define a conveying inclined toward the inlet side and the upper guide member 43 and the lower guide member 44 jointly define a conveying path 46 inclined toward the outlet side. These conveying paths 45, 46 open outside the print unit 8*a*. In the unit cases 20, depressed parts 47 corresponding to the upper guide members 41, 43 are formed as illustrated in FIG. 12. When the upper cover 26 is in a shut state as illustrated in FIG. 10 and FIG. 11, the upper cover 26 comes into contact with the depressed part 47 and, as a result, the upper cover 26, the platen roller 2, the paper-retaining roller 14, etc. are set in place.

The print unit 8*a* of the thermal printer 1*c* is not provided with either of the operating member 21 and the spring 31 which are used in the print unit 8 of the thermal head 1 illustrated in FIG. 1. The thermal head 3 is directly depressed by the drive lever 18. The function of fine adjustment to be fulfilled by the spring 31 is accomplished by the adjustment of the position of the upper limit of the reach of the drive lever 18. To the thermal head 3, a peel member 48 adapted to peel the inked ribbon R from the recording paper P is attached.

To the frame assembly 4 of the thermal printer 1*c*, a guide 50 is attached as extended in the horizontal direction so as to cover the entire upper surface of the print unit 8*a* as illustrated in FIG. 10. The right side part of the guide 50 defines a conveying path 51 and the left side part thereof defines a conveying path 52 respectively in conjunction with the upper cover 26. The conveying path 51 communicates with the conveying path 45 and the conveying path 52 with the conveying path 46. The central part of the guide 50 collides against the upper surface of the upper cover 26 of the print unit and exerts slight pressing force on the upper cover 26 and consequently sets the print unit 8*a* in place. This guide 50 guides the print unit 8*a* during the removal or insertion of the moving tray 6 and smoothens the work of loading of the print unit 8*a* in the printer 1*c*.

In this printer 1*c*, the recording paper P is forwarded from the paper-feeding cassette 7 through the conveying paths 51, 45, then passed through the gap between the platen roller 2 and the thermal head 3 and the paper-retaining roller 14, further passed through the conveying paths 46, 52, and finally discharged out of the printer. This printer 1*c*, like the printer 1, has the front surface thereof on the left side in the bearings of the drawing. The moving tray 6 is drawn out through the opening part 25.

Figure 13:
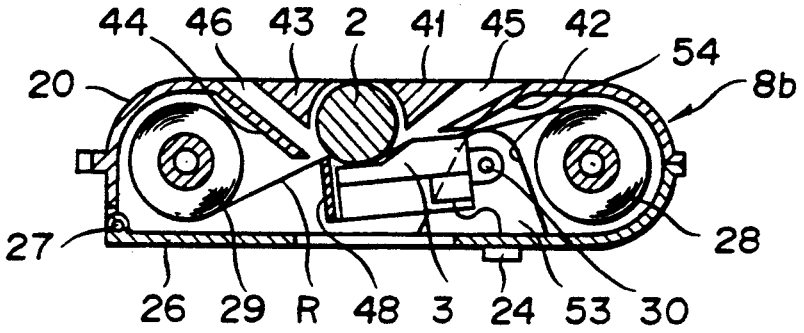
FIG. 13 is a cross section illustrating a print unit as the fifth embodiment of this invention.
Figure 14:
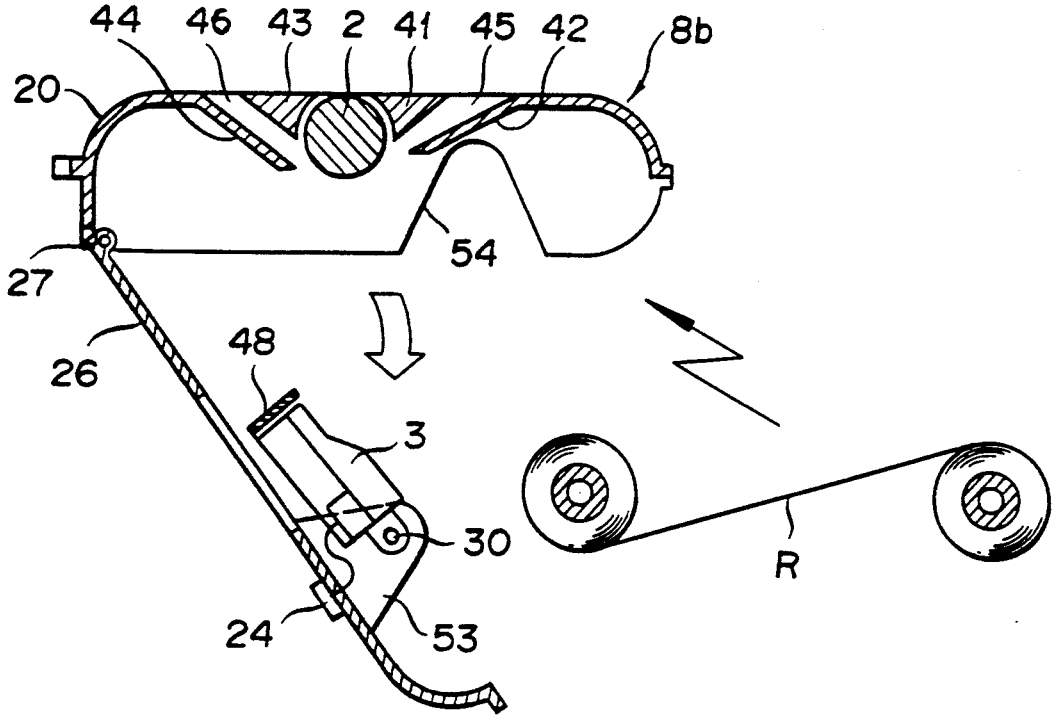
FIG. 14 is a cross section illustrating the print unit of FIG. 13 in a position having the lower cover opened.

FIG. 13 and FIG. 14 illustrate a printer unit 8*b* of another type to be loaded in the printer 1*c* illustrated in FIG. 10. This print unit 8*b* is provided on the lower side of the unit case 20 with the lower cover 26 which is set so as to be opened and shut around the pin 27 as the center. This print unit 8*b*, therefore, is opened on the lower side thereof. In this case, the platen roller 2 is attached to the unit case 20 on the upper side and the inked ribbon R which is unwound from the supply reel 28 and rewound on the take-up reel 29 is accommodated in the unit case 20. To the lower cover 26, the thermal head 3 is attached as enabled to be shaken around the pin through the medium of a bracket 53 which is formed integrally with the lower cover 26. The connector 24 is attached to the lower side of the lower cover 26. In the unit case 20, a notched part 54 is formed at the position corresponding to that of the bracket 53. When the lower cover 20 is shut, therefore, the bracket 53 collides against the notched part 54 and consequently sets the lower cover 26, the thermal head 3, etc. in place. In the print unit 8*b* of this type, the unit case 20 and the lower cover 26 may be integrally formed and used as a tightly closed item. In this case, the print unit 8*b* accommodating therein the platen roller 2, the thermal head 3, the inked ribbon R, etc. constitutes itself a disposable item.

The print units 8*a*, 8*b* described above are adapted so as to incorporate therein not only the thermal head but also the platen roller 2. When they are in a position taken out of the printer 1*c*, the platen roller 2 and the thermal head 3 are separated from each other. The thermal printer 1C which is possessed of the print unit 8*a* or 8*b* of this type enjoys the following advantages in addition to those of the thermal printer 1 of the first embodiment of this invention.

This printer, unlike the conventional printer, obviates the necessity for providing inside the frame assembly 4 an exchange space for allowing the insertion or removal of the inked ribbon R and an escape space or escape mechanism for allowing retraction of the thermal head during the exchange and allows a decrease in the height of the printer and a further reduction in size, weight, and cost.

Since the platen roller 2 is incorporated in the print unit 8*a* or 8*b*, the printer is allowed a further reduction in size as clearly noted from the comparison of FIG. 1 and FIG. 10. Further since the platen roller 2 as well as the component members like the thermal head 3 and the inked ribbon R is incorporated in the print unit 8*a* or 8*b*, the positional accuracy of the platen roller 2 and the thermal head 3 is high, the production and assembly of the printer are easy, and the cost of production of the printer is low.

Further, the print unit 8*a* or 8*b* can be attached or detached through the front side of the printer by the insertion or removal of the moving tray 6 through the opening part 25 on the front side of the printer. Thus, the work of the attachment or detachment is carried out with high efficiency.

Since the print unit 8*a* or 8*b* has the inked ribbon R and the platen roller 2 incorporated therein, the inked ribbon R has no possibility of colliding against the platen roller 2 and has only remote possibility of sustaining damage during the insertion or removal of the print unit 8*a* or 8*b* into or from the printer. Also from this point of view, the print unit 8*a* or 8*b* enjoys high efficiency of the work of attachment or detachment.

After the removal of the print unit 8*b* from the printer, the opening of the lower cover 26 induces separation between the platen roller 2 and the thermal head 3 and consequently facilitates the maintenance of the platen roller 2 and the thermal head 3. Similarly, the extraction of the print unit 8*a* contributes to facilitating the exchange of such consumable supplies as the recording paper P and the inked ribbon R. Further, the extraction of the print unit 8*a* serves the purpose of facilitating the work of troubleshooting which is required as when the recording paper P is stuck in the mechanism.

Figure 15:
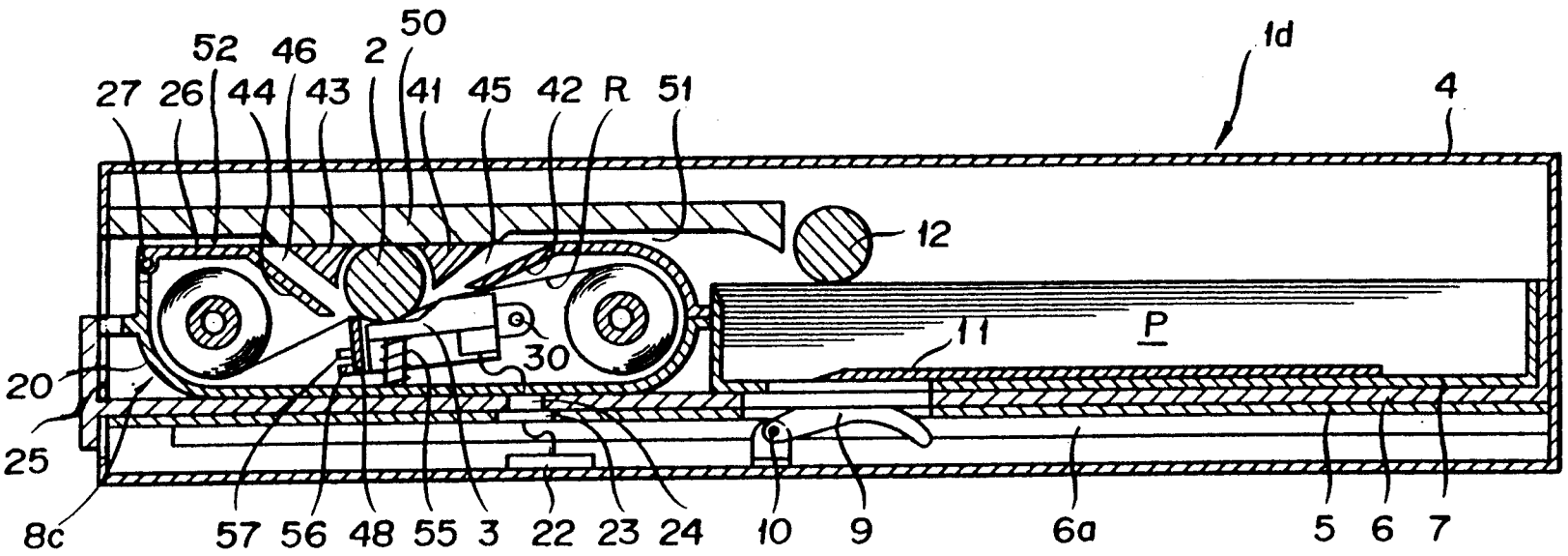
FIG. 15 is a cross section illustrating a thermal printer as the sixth embodiment of this invention.
Figure 16:
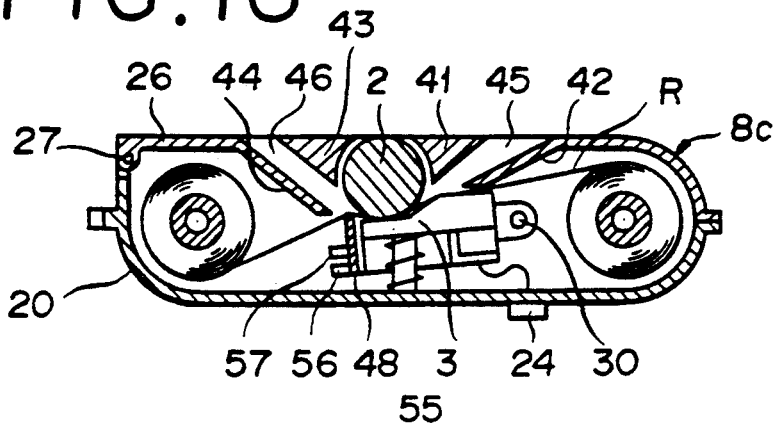
FIG. 16 is a cross section illustrating a print unit built in the thermal printer of FIG. 15.

FIG. 15 and FIG. 16 illustrate a thermal printer 1*d* as yet another embodiment of this invention. The basic construction of this printer 1*d* is identical with that of the printer 1*c* illustrated in FIG. 10, except the thermal head 3 incorporated in the print unit 8*c* is constantly kept pressed against the platen roller 2 by a spring 55 attached to the unit case 20. This thermal printer 1*d*, therefore, is not provided in the frame assembly 4 thereof with the drive lever 18 described above. To the thermal head 3 is attached a projection 56. A stopper 57 adapted to be united with this projection 56 is attached to the unit case 20. As a result, when the cover 26 of the print unit 8 is opened, the platen roller 2 is separated from the thermal head 3 but the rotation of the thermal head 3 around the pin 30 as the center beyond a prescribed magnitude is restricted by the stopper 57.

The thermal printer 1*d* illustrated in FIG. 15 has no use for the drive member otherwise required for making or breaking contact between the thermal head 3 and the platen roller 2, for the thermal head 3 is constantly kept pressed against the platen roller 2. This fact brings about an advantage that the thermal printer is allowed a further reduction in size and cost of production. Particularly, this thermal printer 1*d* is useful not only for printing color images but also for printing monochromic images. Also in the print unit 8*c* of this type, the lower cover 26 may be attached to the unit case 20 so as to be opened or shut as desired.

Figure 17:
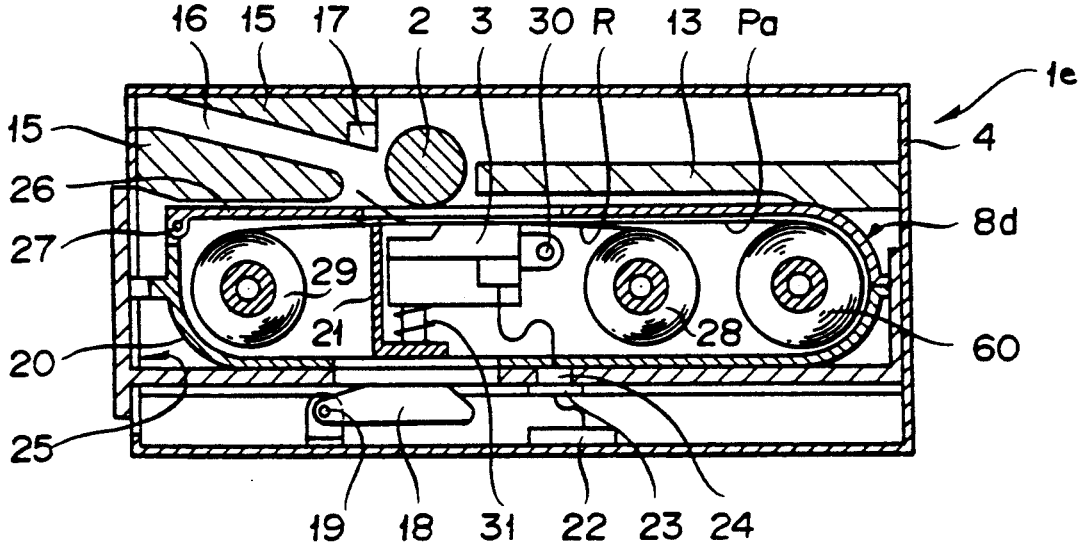
FIG. 17 is a cross section illustrating a thermal printer as the seventh embodiment of this invention.
Figure 18:
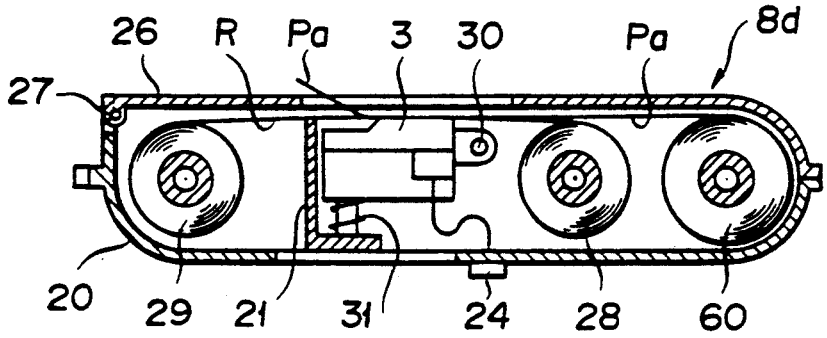
FIG. 18 is a cross section illustrating the print unit shown in FIG. 17.
Figure 19:
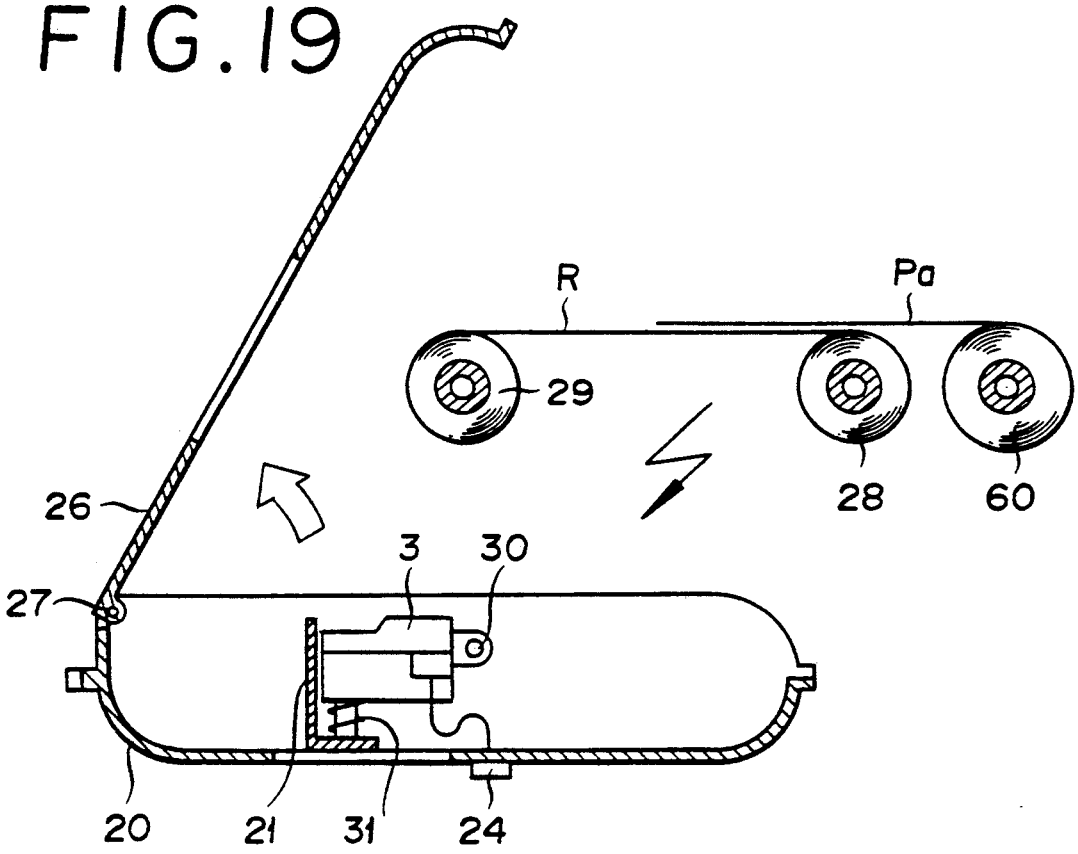
FIG. 19 is a cross section illustrating the print unit shown in FIG. 18 in a position having the upper cover opened.

FIG. 17 is a diagram illustrating a printer 1*e* of still another type. A print unit 8*d* to be incorporated in this printer 1*e* is illustrated in FIG. 18 and FIG. 19.

This print unit 8*d* is so adapted as to accommodate therein a rolled recording paper Pa in addition to the thermal head 3 and the inked ribbon R. A paper roll 60 having the recording paper Pa wound in a roll is accommodated contiguosly to the supply reel 28 in the unit case 20. In the process of printing, the recording paper Pa is unwound from the paper roll 60, guided to the lower side of the upper cover 26, and then conveyed in the direction of the platen roller 2 installed in the frame assembly 4. This printer 1*e* is not provided with any of the paper-feeding cassette 7, the paper-feeding roller 12, and similar component parts used in the aforementioned printer.

This thermal printer 1*e* has the following advantages in addition to the advantages enjoyed by the printers described above. Since the recording paper Pa is adapted to be incorporated in the print unit 8*d*, the printer is allowed a further reduction in size. Since the paper roll 60 is taken out of the printer in conjunction with the print unit 8*d*, the exchange of the recording paper Pa as well as that of the inked ribbon R can be easily carried out. Thus, the troubles such as are caused when the recording paper Pa is stuck in the mechanism can be easily coped with.

Figure 20:
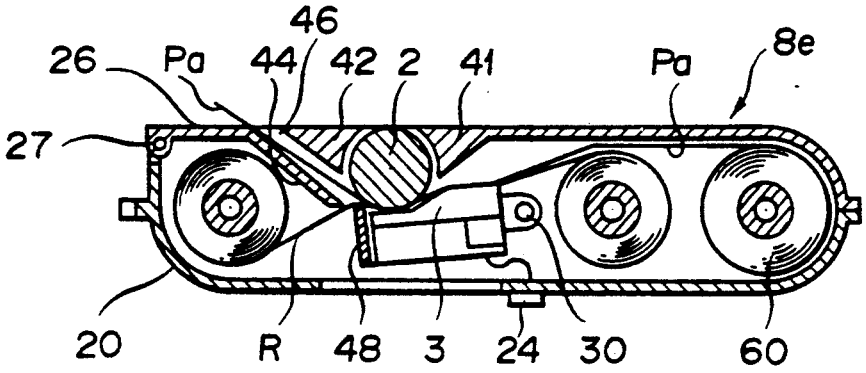
FIG. 20 is a cross section illustrating a print unit as the eighth embodiment of this invention.
Figure 21:
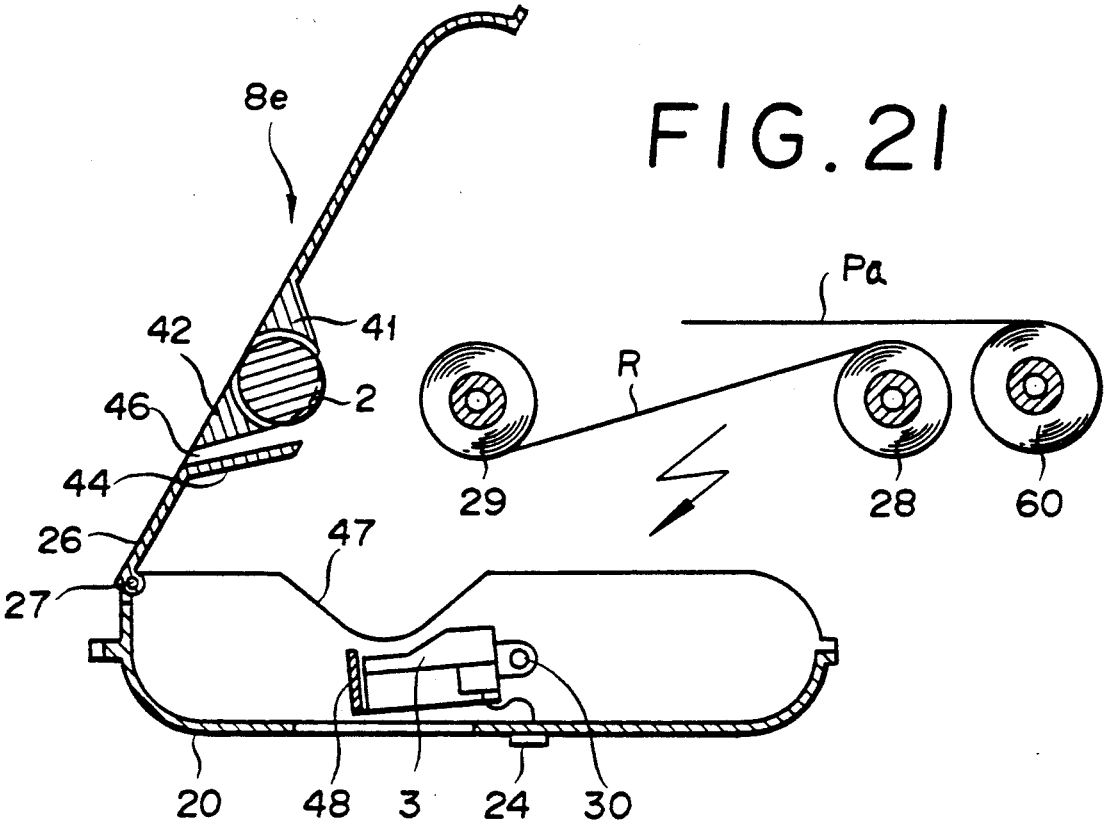
FIG. 21 is a cross section illustrating the print unit shown in FIG. 20 in a position having the upper cover opened.

FIG. 20 and FIG. 21 illustrate a print unit 8*e* of another type which is adapted to accommodate therein the recording paper. The inked ribbon R and the recording paper P are detachably accommodated in the unit case 20 to which the thermal head 3 is attached as adapted to rotate around the pin 30. To the upper cover 26, similarly to that illustrated in FIG. 10, the platen roller 2 is rotatably added. This thermal head 3, as illustrated in FIG. 10, is driven to be displaced by the drive lever installed in the frame assembly 4.

Figure 22:
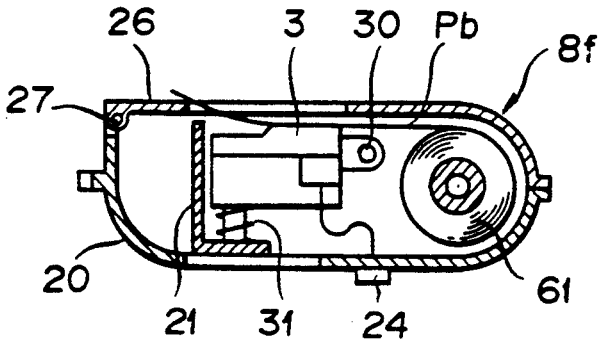
FIG. 22 is a cross section illustrating a print unit as the ninth embodiment of this invention.
Figure 23:
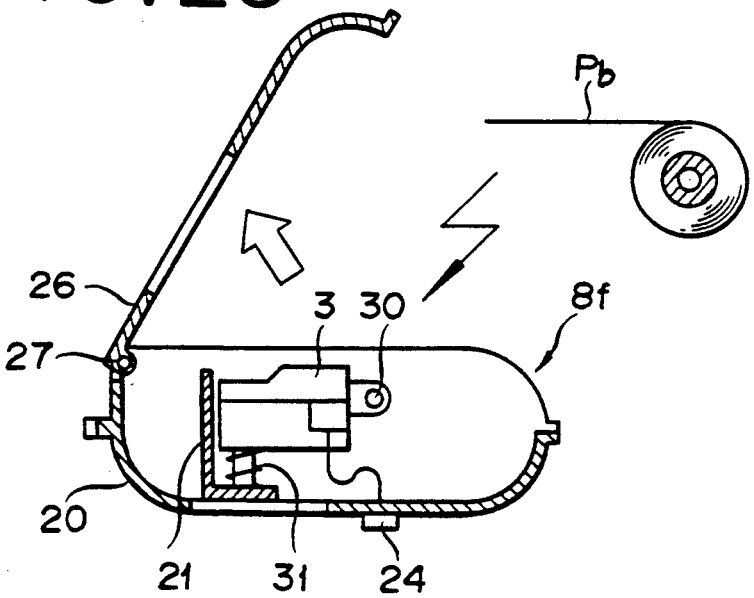
FIG. 23 is a cross section illustrating the print unit shown in FIG. 22 in a position having the upper cover opened.

FIG. 22 and FIG. 23 illustrate a print unit 8*f* as yet another embodiment of this invention. This print unit 8*f* is so adapted as to accommodate therein a roll 61 of thermosensitive paper Pb as a recording medium. Since the thermosensitive paper Pb is used as the recording medium, this print unit 8*f* has no use for the inked ribbon R which is used in each of the print units described above. This thermal head 3 is adapted to be pressed against the platen roller (not shown) disposed in the printer's frame assembly. This thermal head 3, similarly to that of the printer illustrated in FIG. 1, is driven to be displaced by the drive lever.

Figure 24:
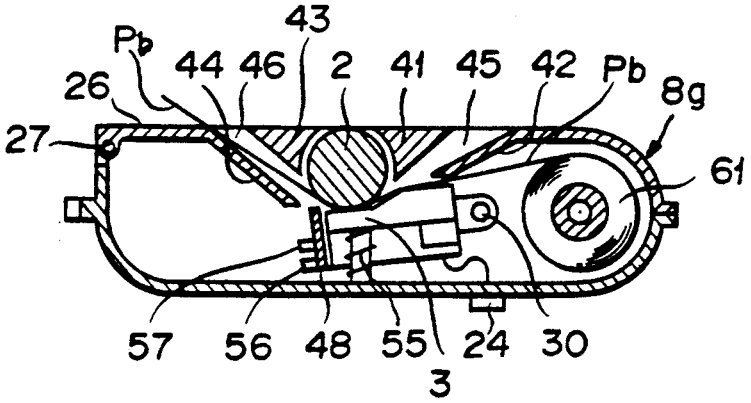
FIG. 24 is a cross section illustrating a print unit as the tenth embodiment of this invention.
Figure 25:
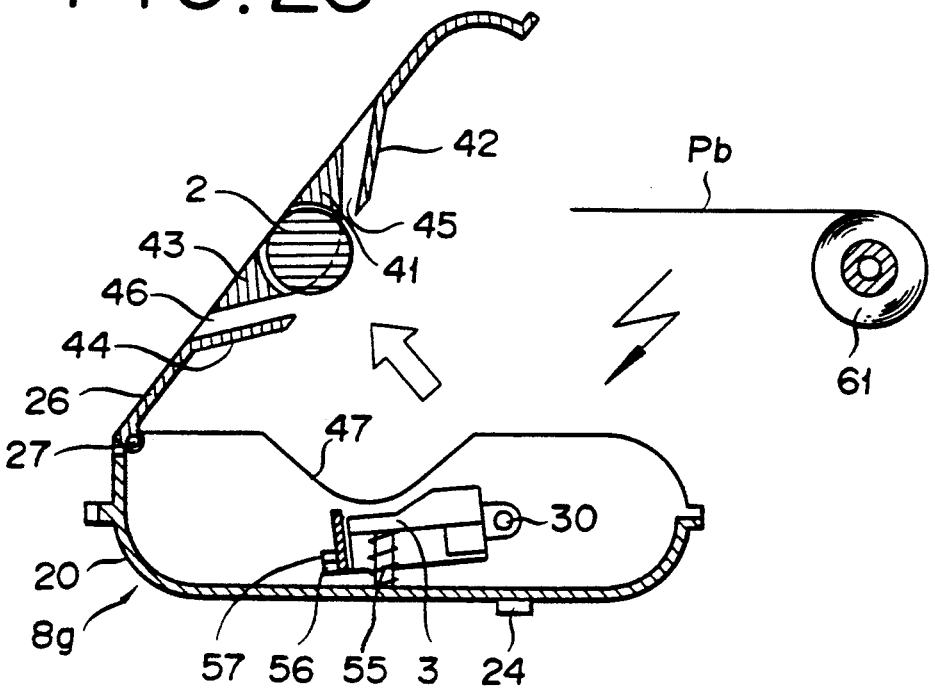
FIG. 25 is a cross section illustrating the print unit of FIG. 24 in a position having the upper cover opened.

FIG. 24 and FIG. 25 illustrate a print unit 8*g* of yet another type using a thermosensitive paper Pb as a recording medium. This print unit 8*g*, similarly to the countertype illustrated in FIG. 22 and FIG. 23, is adapted to accommodate therein the roll 61 of thermosensitive paper Pb. The cover 26 has rotatably attached thereto the platen roller 2 against which is pressed the thermal head 3. Similarly to the print head 8*c* illustrated in FIG. 16, the pressing force which the thermal head 3 exerted on the platen roller 2 is enhanced by the spring 55. The stopper 57 for engagement with the projection 56 attached to the thermal head 3 is formed inside the unit case 20 and enabled to restrict the position of rotation of the thermal head 3. Thus, no drive lever is installed in the frame assembly of the printer which is furnished with the unit 8*g* of this type.

While this invention has been illustrated and described in accordance with a preferred embodiment, it is recognized that variations and changes may be made and equivalents employed herein without departing from the invention as set forth in the claims.

What is claimed is:

1. A thermal printer possessing a platen roller and a thermal head adapted to be pressed against said platen roller through the medium of a recording paper and recording an image on said recording paper, comprising:

a recording medium;

a print unit for displaceably retaining and accommodating said thermal head and for accommodating said recording medium;

a thermal printer main body;

means for attaching or detaching said print unit to said thermal printer main body; and pressing means installed in said thermal printer main body, and adapted to remain in said thermal printer main body when said print unit is detached from said thermal printer main body, for pressing said thermal head against said platen roller when said print unit is attached to said thermal printer main body.

2. A thermal printer according to claim 1, which further comprises connectors adapted to electrify the thermal head in said print unit and disposed correspondingly in said print unit and said thermal printer main body.

3. A thermal printer according to claim 1, which further comprises a slide base, and means for inserting said slide base into or removing said slide base from said thermal printer main body, said slide base having said print unit and a cassette for containing a recording paper separately mounted thereon and removable therefrom when said slide base is removed from said printer main body, and wherein said recording medium comprises an inked ribbon.

4. A thermal printer according to claim 1, wherein said print unit further includes means for containing said recording paper.

5. A thermal printer according to claim 1, wherein said recording medium comprises an inked ribbon.

6. A thermal printer according to claim 1, wherein said recording medium comprises a thermosensitive recording paper.

7. A thermal printer possessing a platen roller and a thermal head adapted to be pressed against said platen roller through the medium of a recording paper and recording an image on said recording paper, comprising:

a recording medium;

a print unit for rotatably retaining and accommodating said platen roller, for displaceably retaining and accommodating said thermal head, and for accommodating said recording medium, a thermal printer main body; and means for attaching or detaching said print unit to said thermal printer main body, wherein said platen roller is rotatably retained by a first portion of said print unit and said thermal head is retained by a second portion of said print unit, wherein said print unit includes means for separating said first and second portions for forming an opening between said platen roller and said thermal head when said print unit is in a position detached from said thermal printer main body, and wherein the printer main body is provided therein with pressing means for pressing said thermal head against said platen roller.

8. A thermal printer possessing a platen roller and a thermal head adapted to be pressed against said platen roller through the medium of a recording paper and recording an image on said recording paper, comprising:

a recording medium;

a print unit for rotatably retaining and accommodating said platen roller, for displaceably retaining and accommodating said thermal head, and for accommodating said recording medium, a thermal printer main body; and means for attaching or detaching said print unit to said thermal printer main body, wherein said platen roller is rotatably retained by a first portion of said print unit and said thermal head is retained by a second portion of said print unit, wherein said print unit includes means for separating said first and second portions for forming an opening between said platen roller and said thermal head when said print unit is in a position detached from said thermal printer main body, and wherein said recording medium comprises an inked ribbon.

9. A thermal printer according to claim 8, wherein said print unit further includes means for detachably accommodating therein a roll of recording paper on which a print is formed by the use of said thermal head and said inked ribbon.

* * * * *

UNITED STATES PATENT AND TRADEMARK OFFICE

CERTIFICATE OF CORRECTION

PATENT NO. : 5,248,207

DATED : September 28, 1993

INVENTOR(S) : Junichi Yamamoto, et al.

It is certified that error appears in the above-identified patent and that said Letters Patent is hereby corrected as shown below:

On the Title Page, line 18 of the Abstract paragraph, delete "and" (second occurrence).

In col. 3, line 51, change "thermal head 3" to --platen roller 2--.

In col. 9, line 2, change "44" to --42--.

In col. 9, line 3, after "conveying" insert --path 45--.

Signed and Sealed this

Nineteenth Day of April, 1994

Bruce Lehman

*Attest:*

BRUCE LEHMAN

*Attesting Officer*

*Commissioner of Patents and Trademarks*